US005800889A

United States Patent [19]

Greene

[11] Patent Number: 5,800,889

[45] Date of Patent: Sep. 1, 1998

[54] COMPOSITE FILLED HOLLOW STRUCTURE

[76] Inventor: Robert H. Greene, 131 Stable Dr., Lancaster, Pa. 17603

[21] Appl. No.: 770,111

[22] Filed: Dec. 20, 1996

Related U.S. Application Data

[63] Continuation-in-part of Ser. No. 915,315, Jul. 20, 1992, abandoned.

[51] Int. Cl.[6] ..... B29D 22/00

[52] U.S. Cl. ..... 428/36.91; 428/34.5; 428/36.4; 52/722; 52/723; 52/724; 52/725

[58] Field of Search ..... 428/34.4, 34.5, 428/34.6, 34.7, 35.7, 36.1, 36.2, 36.4, 36.91; 106/772; 52/722, 723, 724, 725

[56] References Cited

U.S. PATENT DOCUMENTS

| | | | |
|---|---|---|---|
| 3,957,250 | 5/1976 | Murphy | 256/19 |
| 4,157,263 | 6/1979 | Gaines et al. | 106/89 |
| 4,939,037 | 7/1990 | Zion et al. | 428/36.3 |
| 5,587,035 | 12/1996 | Greene | 156/187 |

*Primary Examiner*—James J. Seidleck
*Assistant Examiner*—Michael A. Williamson
*Attorney, Agent, or Firm*—Farkas & Manelli PLLC

[57] ABSTRACT

A filled structure includes a fiber reinforced resinous hollow structure having a tensile strength of at least 30,000 psi and an inside surface forming a boundary which encloses a space. A hard core is provided within the space enclosed by the hollow structure. The hard core has a density of at least 35 pounds per cubic foot and a compressive strength of at least 1500 psi. The hard core is formed from a mixture of particulate cementitious material and liquid. The filled structure is constructed and arranged such that the hard core is locked to the inside surface of the hollow structure by mechanical bond or chemical lock or stressed expansion.

18 Claims, 2 Drawing Sheets

COMPOSITE FILLED HOLLOW STRUCTURE

This is a continuation-in-part of my application Ser. No. 07/915,315 filed Jul. 20, 1992, now abandoned.

BACKGROUND OF THE INVENTION

This invention deals generally with stock material, and more specifically with filled hollow structures such as light poles, fence posts and pilings constructed of plastic or fiberglass.

The benefits of plastic and fiberglass for articles which are used where they are subject to corrosion are generally well recognized. Structures using such materials are light weight, strong, and attractive. They can be made with color integrated into the material so that they do not need frequent painting during their use, and possibly their greatest asset is the inherent chemical resistance of the materials. A fiberglass or plastic structure such as a fence post can be expected to last as long as anyone wants it to, even in the most severe environment, with no sign of deterioration, and it will not require any maintenance.

Unfortunately, the major limitation on the availability of such pole type fiberglass or plastic structures has been the cost and difficulty involved in their manufacture. One typical method of fiberglass construction is the forming of the fiberglass into a specific shape by wrapping multiple layers of fiberglass fabric on the outside of a core and impregnating the fabric with resin or epoxy, however such manufacturing methods are very expensive because they involve a great deal of hand labor.

Another approach, particularly to the construction of cylindrical structures, is to use preformed fiberglass or plastic pipe. However, such pole structures are not strong enough for most applications unless the pipe is very thick or the structure includes wood or metal reinforcing, and both of these approaches raise the cost of fiberglass and plastic poles so that they are not competitive with conventional metal poles.

One approach to reinforcing fiberglass or plastic pipe so it can be used as a structural member has been the use of fillers which are poured into the inside of the pipe, and then harden into a core. Fillers have been suggested which include wood with an adhesive binder (U.S. Pat. No. 4,602,765 by Loper) and rigid foam or concrete (U.S. Pat. No. 3,957,250 by Murphy), but these approaches do not furnish strength comparable to metal poles.

SUMMARY OF THE INVENTION

The present invention improves upon the technique of filling the interior of a hollow member to reinforce it by using a particular filler material mixture which produces a structure of greater strength by creating a stronger core and a superior bond to the exterior member. This is accomplished by selecting a material which normally expands while it is hardening, but is contained by the tubular form, thereby producing a strong core with a stressed set and a force fit bond with the external member.

In the preferred embodiment of the invention, the material used for the core is a Portland-type cement based structural material. Such material would expand as it is setting up except that it is restrained from expanding by the external member. The external member selected for the outside of the pole is selected to have a structural strength which is greater than the expansion force of the core structural material.

Therefore, as the core material hardens, it forms a plug with a permanent positive stress and a higher than usual density within the external member, and this plug is locked tightly within and virtually bonded to the external member.

In effect, a compression stressed core member is formed within and integrated with the external member, and this gives the filled hollow structure greater strength than would result from a core material which does not expand upon hardening, because a core made of such a non-expanding material could shrink and slide within the external member at the boundary between the external member and the core. To derive the full benefit of the filled hollow structure, the core material must also have great enough structural strength to add significantly to the strength of the finished structure.

An additional benefit of the structure of the preferred embodiment is that the external member protects the core material from any environmental factors which might otherwise cause the core material to deteriorate with exposure.

Two other techniques are also used to increase the strength of the filled hollow structure. One, which is available only for structures which include fiberglass in the external hollow member, involves the specific orientation of the rovings of the fiberglass used in the external member. When the external member is constructed so that the fiberglass rovings in it are longitudinally oriented with respect to the axis of the external member, it has greater resistance to bending than does a structure in which the rovings are aligned perpendicular to the axis. This increase in strength is not sufficient to permit the use of an external member without a strengthened core.

Another benefit can be secured from the selection of a proper veil coating on the outside surface of the external member. Such veil coatings are often used to protect fiberglass reinforced products from deterioration caused by exposure to ultraviolet rays.

A final additional coating can also be added to the pole structure of the present invention to add particular surface finishes and additional ultraviolet protection.

Another aspect of the invention is to provide a filled structure including a fiber reinforced resinous hollow structure having a tensile strength of at least 30,000 psi and an inside surface forming a boundary which encloses a space. A hard core is provided within the space enclosed by the hollow structure. The hard core has a density of at least 35 pounds per cubic foot and a compressive strength of at least 1500 psi. The hard core is formed from a mixture of particulate, cementitious material and liquid. The filled structure is constructed and arranged such that the hard core is locked to the inside surface of the hollow structure. The locking is provided by a mechanical lock, such as roughening an inside surface or by the molding of ridges into the inside surface of the hollow structure, where the core envelopes the ridges and/or fills the valleys, or by a chemical lock, such as providing an adhesive on the inside surface of the hollow structure.

The hard core may expand its volume as it hardens, with the expansion of the mixture being restrained by the hollow structure and the hard core exerting a force against the inside surface of the hollow structure.

The present invention therefore furnishes a highly desirable improvement for fiberglass and plastic filled hollow structures which makes them practical to use for such common and cost sensitive applications as light poles, fence posts and pilings, since they can now be competitive with metal poles and other traditional materials.

DETAILED DESCRIPTION OF THE INVENTION

Figure 1:
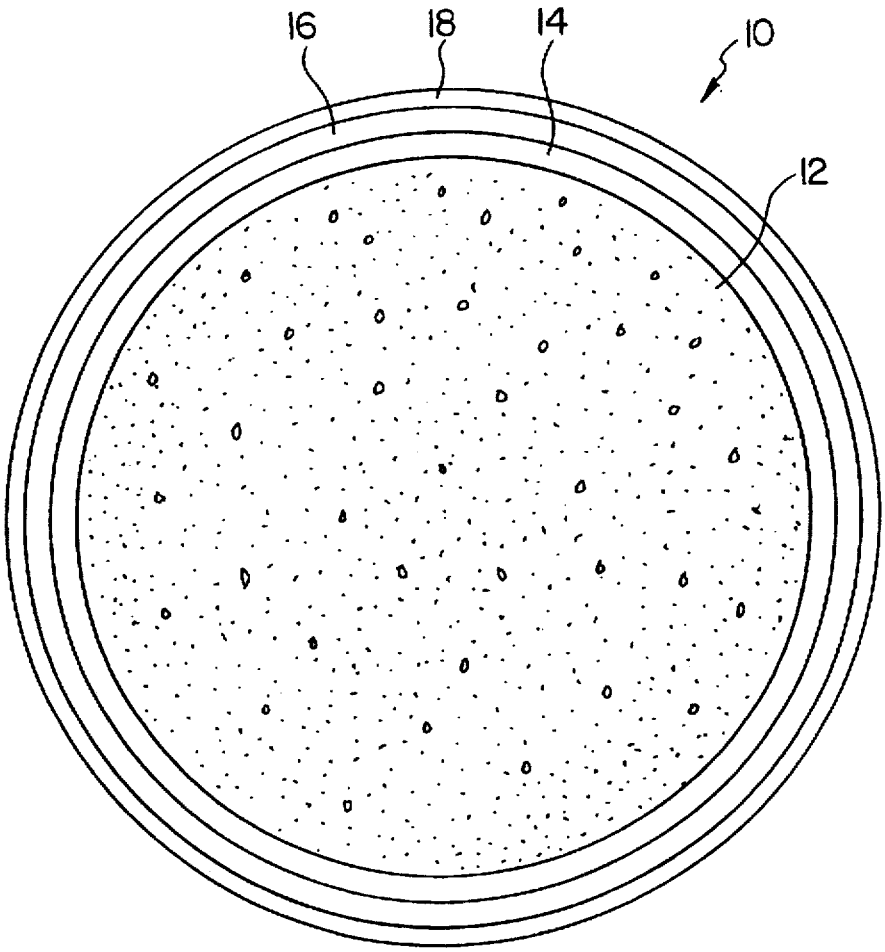
FIG. 1 is an end view across the axis of an embodiment of the invention.

FIG. 1 shows an end view across the axis of pole 10 of the preferred embodiment. Pole 10 is preferably formed of four distinct materials, one of which, core 12, takes on a particular significance because of the manner in which it is formed. Core 12 is encased within pipe 14 which is covered by veil 16, on top of which is placed protective surface coating 18. Each of the four parts of composite pole structure 10 adds a particular characteristic to the pole structure, and together they furnish a pole of superior strength and durability which can be produced economically. In the broadest aspect of the invention, the veil 16 and coating 18 need not be provided.

The construction of pole 10 is essentially based upon the filling of pipe 14 with core 12, but core 12 has unique properties which produce a non-metallic pole with strength equivalent to that of steel poles. Core 12 is a Portland cement based product with admixtures which enables the mixture to expand as it hardens, or at least limit shrinkage of the mixture as it hardens.

In the preferred embodiment, it is important that the core material normally expand in order that it have a permanent positive stress and produce a force fit with exterior pipe 14. It is also vital that the hardened core have significant strength, which is best indicated by a compressive strength rating of at least 1500 psi, so that it adds significant strength to the structure and does not act to merely fill the interior space of the pipe. The load/force developed as the core 14 hardens must, however, be less than the structural strength of pipe 14 in order to prevent the forces produced by the attempted expansion during hardening of core 12 from distorting and/or substantially weakening pipe 14 as it restrains the expansion of core 12.

In the preferred embodiment, cylindrical pipe 14 has a two inch outer diameter with 0.030 inch wall thickness up to a ninety-six inch diameter with at least 0.500 inch wall thickness. The pipe 14 is constructed with a standard polyester, epoxy or vinyl ester resin base, reinforced with fibrous roving, chop, or woven mat throughout its entire thickness. Such a material has a tensile strength of at least 30,000 psi. Added bending strength can be attained if the significant portion of the fibrous roving are oriented to be at an angle of at least 45 degrees to the axis of the pole. The fibrous roving in the illustrated embodiment is fiberglass. It can be appreciated that other fibrous rovings such as carbon, etc. may be used.

As with all fiberglass and resin structures, color pigments may be added during manufacture of pipe 14 to produce consistent color throughout the entire pipe.

It is also advantageous to produce veil 16 on the exterior surface of pipe 14 when it is being manufactured. Veil 16 is a layer of polyester or other material cloth impregnated with resin. The production of such a veil is well understood by those skilled in the art of fiberglass construction. Veil 16 protects the fiberglass against ultraviolet radiation, provides a moisture barrier, protects against blooming of the surface fibers of the fiberglass and also adds strength to pole 10.

The core 12 is composed primarily of a mixture of stone, sand, water, and Portland-type cement. In the preferred embodiment, the specific material used is Type I Portland-type cement as manufactured by the Lehigh Cement Co. The stone component could be solid limestone, as commonly found at may local quarries, or lightweight type aggregate as produced, for example, by Solite Corp. The sand component is clean washed and specifically graded round silica material as is available from many local sand quarries. Normal potable water is used and other cementitious products may be employed to promote expansion or at least limit shrinkage of the core upon hardening. For example, Expansion additives such as INTRAPLAST N manufactured by Sika (plastic state expansion), or CONEX, as manufactured by IAI Cement Co. (early hardened state expansion) may be used in the core. Alternatively, a standard expansion agent such as alumina hydrate may be employed in the core, or the core may comprise Type K cement.

When hardened this formula yields a compressive strength of 1500–15,000 psi. Moreover, this particular formula normally expands about 0.1–10 percent upon hardening, except that it is restrained by the hollow tube 14 and therefore provides an exceptionally strong force fit with hollow tube or pipe 14. The density of such a core is at least 35 pounds per cubic foot. The mixture may be formulated such that shrinkage is limited or made to be generally negligible, unlike shrinkage which may occur in normal cement-type products.

Protective coating 18 may also be added to pole 10, for the purpose of enhancing ultraviolet protection and corrosion resistance and to produce a smooth surface. The coating 18 is applied during the manufacture of the pipe and is at least 0.001 inch thick. Protective coating 18 is clear, can be made with or without pigments, and includes specific ultraviolet absorbers and/or shields. An example of such a coating could be "Amerishield" as manufactured by Ameron Corp. or "Tufcote" as manufactured by DuPont.

The composite pole of the present invention can furnish bending strength equal to or greater than Schedule 40 steel pipe (ASTM F-1083) of the same diameter, and its inherent corrosion resistance is far superior to that of steel. Moreover, the present invention actually furnishes a pole which will flex more than twice as far as steel and return to its original shape without failure.

Figure 2:
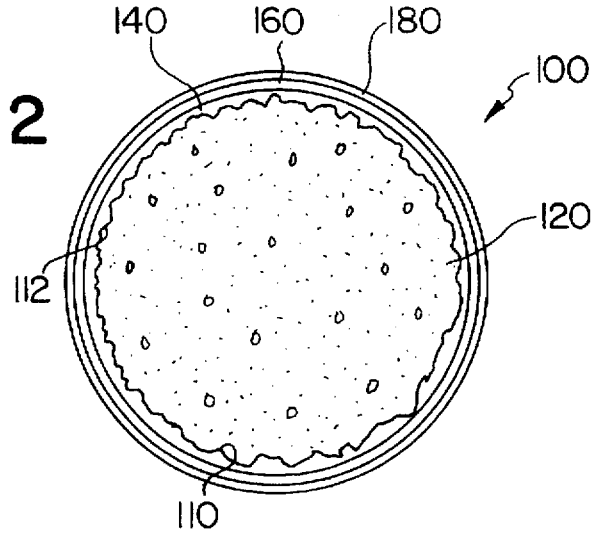
FIG. 2 is an end view across the axis of another embodiment of the invention.
Figure 4A:
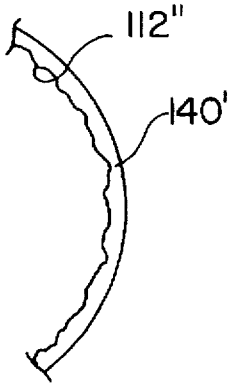
FIG. 4*a* is a partial end view of concave ridges formed in a pipe of the invention.
Figure 4B:
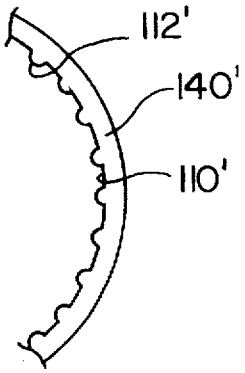
FIG. 4*b* is a partial end view of convex ridges formed in a pipe of the invention.

FIG. 2 shows another embodiment of a composite pole structure 100 of the invention. As shown, the inner surface 110 of the pipe 140 is roughened to form a regular or irregular pattern therein. In the illustrated embodiment, the inner surface 100 includes an irregular pattern defining a plurality of recesses 112 which increases the surface area contact between the core 120 and the pipe 140 when the core 120 hardens within in the pipe 140. Thus, a portion of the core 120 is disposed in the recesses 112 defining a mechanical lock between the core 120 and the pipe 140. The core 120, pipe 140, veil 160 and coating 180 are otherwise identical to the embodiment of FIG. 1. Alternatively, as shown in FIGS. 4*a* and 4*b*, instead of the recesses, ridges 112' or 112" can be molded or otherwise formed into the inner surface 110' of the pipe 140'. The ridges may be concave 112" (FIG. 4*a*) or convex 112' (FIG. 4*b*) and may be in a regular or an irregular pattern. It can be appreciated, however, that the core 120 need not be of the type which expands its volume when it hardens to provide a force fit with the pipe 140, since the mechanical lock provides the desired locking of the core 120 to the pipe 140. It can also be appreciated that the core may be of the type in which shrinkage is limited during hardening thereof.

Figure 3:
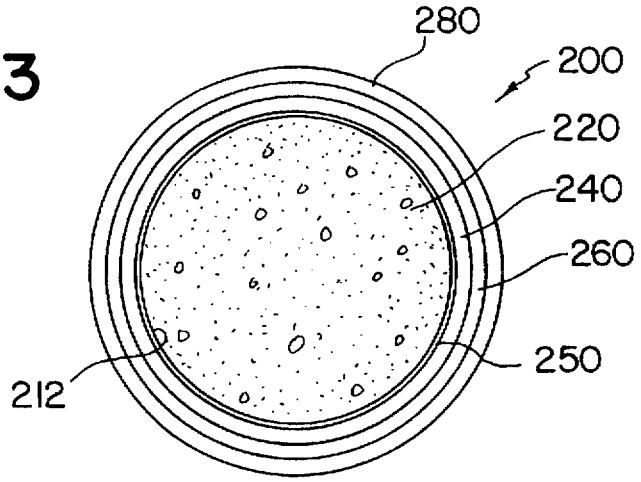
FIG. 3 is an end view across the axis of yet another embodiment of the invention.

FIG. 3 shows yet another embodiment of a composite pole structure 200 of the invention. As shown, an adhesive 250 is coated on the inner surface 212 of the tube 240 such that when the core 220 hardens it is chemically locked with respect to the pipe via the adhesive 250. The adhesive 250 is preferably SIKADUR 32® manufacture by Sika. However, any type of adhesive suitable for securing the resin pipe 240 to the hardened core may be employed. The core 220, pipe 240, veil 260 and coating 180 are identical to the embodiment of FIG. 1. It can be appreciated, however, that the core 220 need not be of the type which expands its volume when it hardens to provide a force fit with the pipe 240, since the chemical lock provides the desired locking of the core 220 to the pipe 240. It can also be appreciated that the core may be of the type in which shrinkage is limited during hardening thereof.

Tests were performed to determine the push-out strength or frictional resistance of the core material to the inner wall of the composite pole structure. The total load in pounds required to dislodge the core from the hollow tube was measured and divided over the unit area and represented in units of psi. The average frictional resistance of the core made in accordance with the embodiment of FIG. 1, (no mechanical or chemical locking of the core) was measured to be on average 25 psi over the entire inner wall surface of the pipe. With the addition of an adhesive 250 bonding the core 220 to the pipe 240 (FIG. 3) the average frictional resistance of the core was determined to be approximately 90 psi. Thus, there is a corresponding minimum increase in bending strength of approximately 30% as a result of a better bond between the core and the pipe which provides for a better transfer of shear between the structural component parts. With both expansion of the core 220 and the use of the adhesive 250 (FIG. 3), failure of the composite structure is often in the cohesive strength of the core 220 itself. Namely, the cohesive strength of the bond between the core and pipe can be stronger than the cohesive strength of the core 220.

Additives 20 may be included in the core of the invention to improve the composite pole structure. For example, silica fume, an extremely fine aggregate that fills tiny voids in the core may be added to the core to improve the compressive thus, making he composite pole structure even stronger. Steel, glass or polymer fibers additives mixed into the core could also be employed. The fibers deter cracking which cause premature failures, provide higher stiffness, provide higher compressive strength and provide higher bending strength, all of which enhance the performance of the composite pole structure.

It is to be understood that the form of this invention as shown is merely a preferred embodiment. Various changes may be made in the function and arrangement of parts; equivalent means may be substituted for those illustrated and described; and certain features may be used independently from others without departing from the spirit and scope of the invention as defined in the following claims.

For instance, structures may be produced without either veil 14 or protective coating 16 when the application does not require ultraviolet protection. Moreover, the diameter and cross sectional configuration of the external member may, of course, vary, and the particular formula of the core could be changed as long as the requirements of the claims are retained. Further, although a generally round cross-sectioned pipe is disclosed, the composite structure may be in any shape or closed section, such as, for example a square, rectangular, oval etc, cross-section.

What is claimed is:

1. A filled structure characterized by the combination of high compressive strength and tensile strength to allow a high bending load, the filled structure comprising:

a fiber reinforced resinous hollow structure having fiber rovings throughout an entire thickness thereof and angled with respect to a longitudinal axis thereof so as to have a tensile strength of at least 30,000 psi and an inside surface forming a boundary which encloses a space, a hard core within said space enclosed by the hollow structure, the hard core having a density of at least 35 pounds per cubic foot and a compressive strength of at least 1500 psi, the hard core being formed from a mixture of particulate cementitious material and liquid, said inside surface being constructed and arranged such that when said core hardens, said hard core is mechanically locked to said inside surface of said hollow structure.

2. The filled structure according to claim 1, wherein substantially all of said inside surfaces is a roughened surface including a plurality of recesses therein which reduce a wall thickness of said hollow structure at each recess and increase a surface area of said inside surface, a portion of said hard core being disposed within said recess, thereby mechanically locking said hard core to said structure.

3. The filled structure according to claim 1, wherein said inside surface includes ridges therein, a portion of said hard core engaging said ridges, locking said hard core to said hollow structure.

4. The filled structure according to claim 3, wherein said ridges are one of concave and convex ridges.

5. The filled structure according to claim 1, wherein said hard core is such that it expands its volume as it hardens, expansion of the mixture being restrained by the hollow structure and the hard core exerting a force against the inside surface of the hollow structure.

6. The filled structure according to claim 3, wherein said hard core expands its volume as it hardens, expansion of the mixture being restrained by the hollow structure and the hard core exerts a force against the inside surface of the hollow structure.

7. The filled structure of claim 1, wherein the hollow structure is a closed section.

8. The filled structure of claim 1, wherein the hollow structure is constructed of fibrous reinforced resin.

9. The filled structure of claim 1, wherein the hollow structure is a cylindrical pipe, the material of the pipe is fiberglass reinforced resin, and the fiberglass comprises roving which are oriented at an angle to the axis of the pipe.

10. The filled structure of claim 1, wherein the mixture from which the core is formed includes a Portland-type cement.

11. The filled structure of claim 4, wherein the mixture from which the core is formed includes stone, sand water and Portland-type cement and an additive which causes expansion of the mixture as it hardens.

12. The filled structure of claim 1, further including a veil attached on the outside of the hollow structure, the veil comprising a cloth material impregnated with resin.

13. The filled structure of claim 1, further including a coating attached on the outside of the hollow structure with the coating comprising a material which absorbs or shields ultraviolet radiation.

14. The filled structure of claim 1, wherein said hard core includes material selected from the group consisting of silica fume, metal glass or polymer fibers, therein.

15. A filled structure characterized by the combination of high compressive strength and tensile strength to allow a high bending load, the filled structure comprising, a fiber reinforced resinous hollow structure having fiber rovings throughout an entire thickness thereof and angled with respect to a longitudinal axis thereof so as to have a tensile strength of at least 30,000 psi and an inside surface forming a boundary which encloses a space, said inside surface including a plurality of ridges therein, a hard core within said space enclosed by the hollow structure, the hard core having a density of at least 35 pounds per cubic foot and a compressive strength of at least 1500 psi, the hard core being formed from a mixture of particulate, cementitious material and liquid, said filled structure being constructed and arranged such that when said core hardens, shrinkage thereof is generally negligible and a portion of said hard core is engaged with said ridges thereby mechanically locking said hard core to said inside surface of said hollow structure.

16. A filled structure characterized by the combination of high compressive strength and tensile strength to allow a high bending load, the filled structure comprising:

a fiber reinforced resinous hollow structure having fiber rovings throughout an entire thickness thereof and angled with respect to a longitudinal axis thereof so as to have a tensile strength of at least 30,000 psi and an inside surface forming a boundary which encloses a space, a hard core within said space enclosed by the hollow structure, the hard core having a density of at least 35 pounds per cubic foot and a compressive strength of at least 1500 psi, the hard core being formed from a mixture of particulate, cementitious material and liquid and is such that upon hardening, shrinkage thereof is generally negligible thereby mechanically locking said hard core to said inside surface of said hollow structure, and an adhesive between said inside surface of said hollow structure and the hard core chemically locking the hard core to said inside surface.

17. The filled structure according to claim 16, wherein said hard core expands its volume as it hardens, expansion of the mixture being restrained by the hollow structure and the hard core exerts a force against the inside surface of the hollow structure, increasing a frictional resistance between said core and said hollow structure.

18. The filled structure of claim 17, wherein a push-out strength of the core is approximately 90 psi against the inside surface of the hollow structure length.

* * * * *